US007658265B1

(12) United States Patent
Dooley

(10) Patent No.: US 7,658,265 B1
(45) Date of Patent: Feb. 9, 2010

(54) ACCESSORY HOLDER FOR STEPLADDERS

(76) Inventor: Darren T. Dooley, 28W135 87th St., Naperville, IL (US) 60564

( * ) Notice: Subject to any disclaimer, the term of this patent is extended or adjusted under 35 U.S.C. 154(b) by 336 days.

(21) Appl. No.: 11/442,713

(22) Filed: May 30, 2006

(51) Int. Cl.
*E06C 7/00* (2006.01)

(52) U.S. Cl. ..... 182/129; 248/210; 248/238

(58) Field of Classification Search ..... 182/129; 248/210, 238
See application file for complete search history.

(56) References Cited

U.S. PATENT DOCUMENTS

| | | | | | |
|---|---|---|---|---|---|
| 488,851 | A * | 12/1892 | Stock | 119/69 |
| 1,045,932 | A * | 12/1912 | Beckworth | 248/298.1 |
| 5,370,263 | A * | 12/1994 | Brown | 220/751 |
| 5,433,413 | A * | 7/1995 | Adams | 248/205.3 |
| 5,673,885 | A * | 10/1997 | Pham | 248/210 |
| 5,782,314 | A * | 7/1998 | Zeitler | 182/129 |
| 5,873,433 | A * | 2/1999 | Katz | 182/129 |
| 5,950,972 | A * | 9/1999 | Irish | 248/210 |
| 7,032,711 | B1 * | 4/2006 | Katz et al. | 182/129 |
| 7,063,187 | B1 * | 6/2006 | Lavigne | 182/129 |
| 2002/0070136 | A1 * | 6/2002 | Hedges | 206/373 |
| 2002/0104709 | A1 * | 8/2002 | Hines | 182/129 |
| 2005/0258002 | A1 * | 11/2005 | Sabo | 182/129 |

* cited by examiner

*Primary Examiner*—Alvin C Chin-Shue
(74) *Attorney, Agent, or Firm*—Richard L. Huff

(57) ABSTRACT

An accessory holder for use on a stepladder. In one embodiment the accessory holder has hangers for holding tools inserted into holders for the hangers. In a second embodiment there is a stepladder having an accessory holder as an integral part thereof. The top member also contains holders for hangers along the periphery for the insertion of hangers for holding accessories. In a third embodiment a frame which fits over the top member of a stepladder contains risers and lateral strips. The accessory holder is secured to the top member of the stepladder by a strap. Hooks and ring hangers are attached to the frame. A front hanger may be swiveled out of the way and bumpers may be added to allow the stepladder to be positioned against a wall.

6 Claims, 10 Drawing Sheets

ACCESSORY HOLDER FOR STEPLADDERS

CROSS-REFERENCE TO RELATED APPLICATIONS

STATEMENT REGARDING FEDERALLY SPONSORED RESEARCH OR DEVELOPMENT (Not Applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to stepladders or devices to be placed on the top of stepladders in order to hold a wide assortment of tools and other accessories.

2) Description of the Related Art

Ladders have been employed since their inception to place workers into proximity to an elevated surface or article that needs be physically manipulated, such as for purposes of painting, plumbing, wiring, etc. Of the several well-known styles of ladders available, a stepladder is perhaps the most common for indoor use. A flat surface is usually provided at the top of the stepladder.

One of the problems individuals who find themselves on ladders regularly encounter is that they must prevent themselves from falling from the ladder while performing the task at hand. Additionally, a variety of hand implements is often required to carry out various tasks to their completion. From a statistical standpoint, the probability of an individual having a mishap varies directly as the number of times an individual goes up and down the ladder in connection with a job. Therefore, if it were possible to minimize the number of up-and-down trips an individual was required to make in the normal course of carrying out tasks from a ladder, then the probability of a mishap could be minimized. Also, people who frequently use ladders to perform work often find that they need to mount and dismount them many times in a day to obtain additional equipment and tools needed to complete their assigned tasks. Having to do this is time consuming and inefficient. Also, repeated climbing up and down ladders tires a worker and over time can adversely affect some workers' leg muscles and knees. Most bags and trays currently used to support tools and equipment at elevation are too small to prevent frequent dismounts, not easily or rapidly secured and released at elevation, not adapted for secure transport and storage of power tools, not adapted to multiple types of elevation support, and/or not sufficiently rugged or durable for long-term use.

One way to minimize the number of up-and-down trips required to carry out a task is to provide every tool and/or material needed for a given job in close proximity to the location atop the ladder where the worker is situated. However, while the prior art contains many different types of devices aimed at this end, none has been successful in design both so as to be ergonomically effective, and sufficiently cost-effective to manufacture so as to be widely adopted.

A review of some of the criteria that a ladder tool holder would desirably realize is useful. Flexible and removable fabric-type, holders seemingly offer a large holding capacity, but these holders tend not to maintain a defined volume, and are subject to collapsing inwardly. This is adverse in that even a loaded holder should be capable of being slipped into position on a step ladder by use of one hand. The holder must maintain itself open and ready to be mounted upon the step ladder. Moreover, a holder removed from a ladder should not slump or collapse so completely that held objects such as tools become dislodged.

Another type of accessory holder is a foldable tray or platform attached to the front support legs of a ladder and which tray may then be pivoted to an out-of-the-way position when not in use or when the ladder is stored.

Many ladder trays or article holders attachable to a ladder can be found in the prior art and the following are representative:

U.S. Pat. No. 2,444,096 shows a paint receptacle for use with roller-type applicators having a tray which is supported by a foot which engages the top of a stepladder.

U.S. Pat. No. 3,991,961 shows a mounting bracket which carries a pivot which, in turn, supports a holder such as a collapsible bag. The device is not specifically for use with a ladder and may be attached to a window sill or ledge to assist in such tasks as washing windows. When not in use, the holder may be rotated so that it may be positioned out of the way.

U.S. Pat. No. 4,261,435 shows a tray with a clip and wire frame support for secure mounting on the top of a stepladder. The tray is shaped to hold tools and has small pockets for containment of small items.

U.S. Pat. No. 4,300,740 shows a movable shelf for a stepladder. The shelf has a pair of brackets which, for example, may engage the edge and underside of either a step or the top of a ladder. Stop members in the form of pins may be engaged to prevent the shelf from sliding when in place.

U.S. Pat. No. 4,460,063 shows a stepladder work bench which is hingedly attached to a stepladder, allowing it to be raised and hooked in place for use and lowered against the stepladder rails for storage.

U.S. Pat. No. 4,773,535 shows an open-bottomed, non-folding, vertical sided, box-like tool holder that sits on top of a folding stepladder.

U.S. Pat. No. 5,501,753 shows a paint can holder with a collar which suspends a paint can to facilitate painting directly from the can. The device is attached or supported from the top of a stepladder.

U.S. Pat. No. 5,638,915 shows a foldable tool holder with a rectangular central top panel that rests on top of a stepladder and four pocketed rectangular side panels that hang down from the respective edges of the top panel and are attached to it by various means, including sewn stitching, a zipper, straps, and rivets. Straps are provided on the lower ends of the side panels for tying them to the ladder's support rails.

U.S. Pat. No. 5,647,453 show a foldable tool holder with a rectangular central top panel that fits on top of a stepladder and four pocketed trapezoidal side panels that hang down from the respective edges of the top panel. The side panels are attachable to each other at their lower ends by hook and loop tapes on straps that respectively wrap around the legs, one front step and one back rung of the ladder.

U.S. Pat. No. 5,873,433 shows an improved accessory tray securable to the top cap of the step ladder for the temporary storage of tools, parts, and the like. The accessory tray includes a support which is securable to the top of a stepladder by various clamping arrangements which may include bolts, springs or tie downs. The tray is attached to the support and in the deployed position extends horizontally forward from the front steps of the ladder.

As can be seen from looking at the prior art, there is still a need for a ladder accessory holder which is adapted to hold a wide variety of tools while being simple in design and easy to manufacture and apply to the ladder. A need also exists for a holder which can be useful when the stepladder is used in the stand-alone mode or is supported by a wall.

SUMMARY OF THE INVENTION

The present invention is directed to accessory holders for stepladders and to stepladders which have accessory holders as part of the stepladders.

The first embodiment comprises a cover which fits over the top member of a stepladder. The cover has a handle which allows the accessory holder to be transported. The accessory holder is attached to the top member of a stepladder by a strap. There is a frame which extends around portions the outside of the perimeter of the cover for holding clips which may be attached to small articles. Holders are attached to the periphery of the accessory holder. These holders are adapted for the quick and easy attachment and release of hangers. The hangers may have circular holders or hooks at the bottoms thereof. The accessory holder contains storage trays which may contain small tools or hardware.

The second embodiment comprises a stepladder in which the top member of the stepladder has side, front, and rear skirts. The top member contains a frame around portions of its perimeter and slightly removed from the top member for the attachment of clips. There are hangers which take the form of hooks or circular holders. The proximal ends of the hangers fit into hanger holders which are located at convenient sites around the periphery of the top member. The top member contains a drawer which may contain small tools or hardware.

The third embodiment is an accessory holder in the form of a frame which fits over the top member of a stepladder. The frame is securely attached to the top member of the ladder by a strap.

The accessory holder provides a top surface made up of a plurality of cross pieces or a single one-piece top. The top surface is capable of holding boxes or bins for easy access by the worker.

There is a large hook on the front or rear of the frame which may be used for holding paint buckets, tool bags for multiple small tools, individual large tools, or work pieces so that these items will be in easy reach of the worker. It is understood that "front" refers to that direction which the worker will be facing when standing on the step ladder in the conventional manner and is the side of the ladder containing the supporting member. "Rear" refers to that side of the accessory holder which is facing the ladder member of the step ladder.

There is at least one smaller hook on one side of the frame which is useful for holding tool bags, individual tools, or work pieces so as to be in easy reach of the worker.

The frame contains a hollow ring and a hook extended downwardly from the frame which, in combination, are capable of providing a holder for a motorized tool. An example of such a tool is a cordless electric drill.

Further objects and advantages of this invention will be apparent from the following detailed description of a presently preferred embodiment thereof with reference to the accompanying drawings.

DETAILED DESCRIPTION OF THE INVENTION

Figure 1:
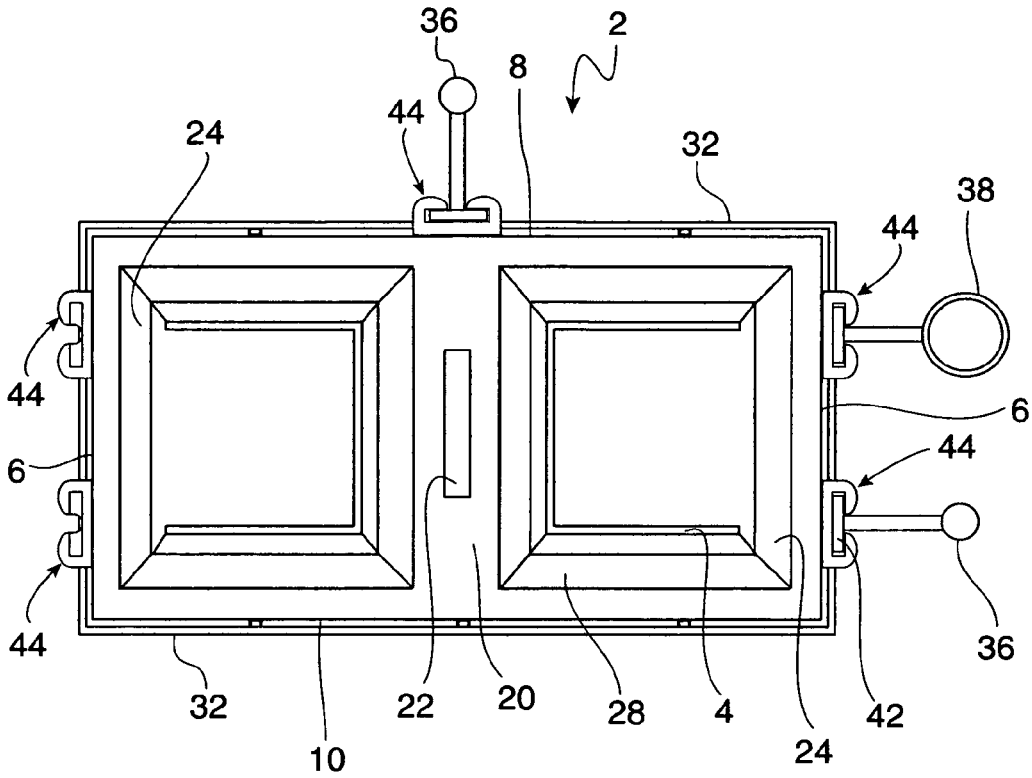
FIG. 1 is a plan view of the accessory holder of the first embodiment of the invention.
Figure 2:
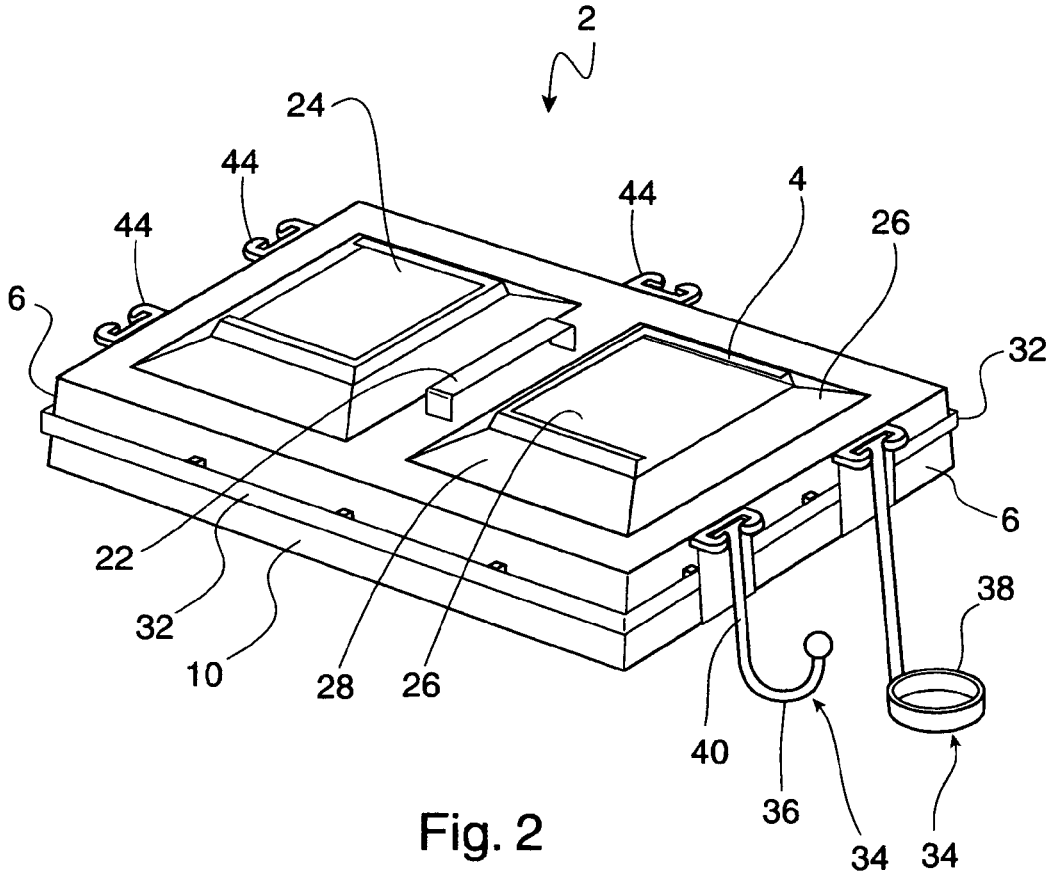
FIG. 2 is an elevational perspective view of the accessory holder of the first embodiment of the invention.
Figure 3:
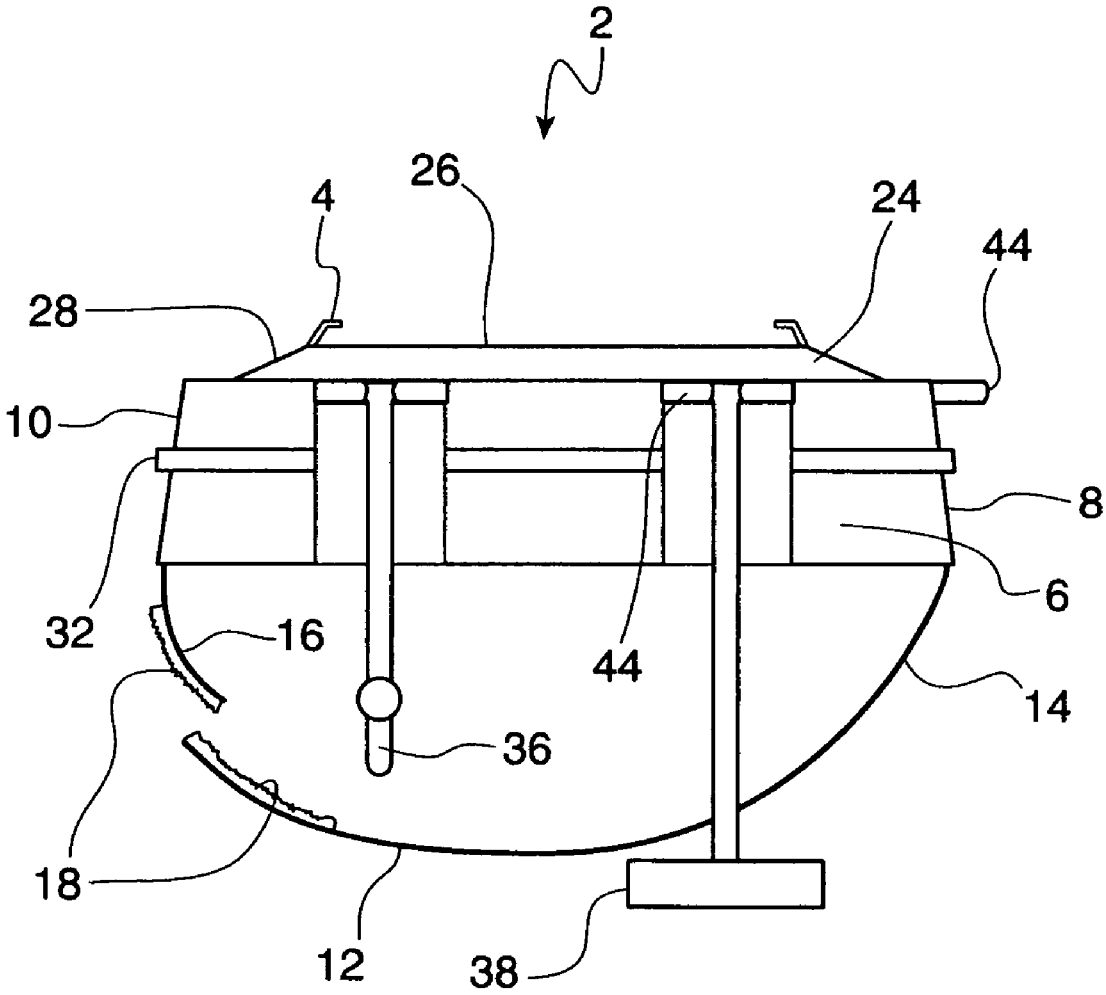
FIG. 3 is an elevational side view of the accessory holder of the first embodiment of the invention.
Figure 4:
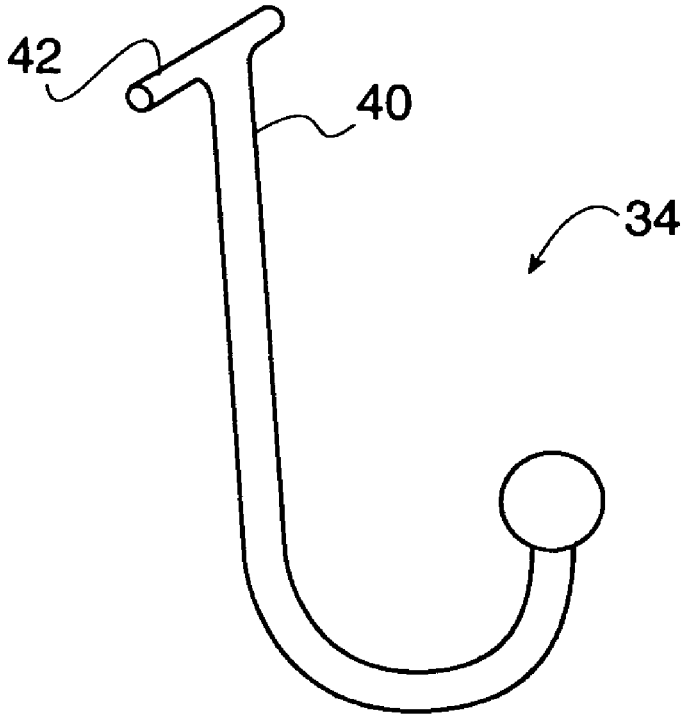
FIG. 4 is an elevational perspective view of a hook to be used with the accessory holder of the first and second embodiments.

The accessory holder of this invention will now be described with reference to FIGS. 1-11 wherein like numerals refer to like features throughout.

A first embodiment will now be described with reference to FIGS. 1-5. The accessory holder 2 of the first embodiment contains two sets of raised retainers 4, two side skirts 6, a front skirt 8, and a rear skirt 10. The accessory holder 2 is so sized as to fit over the flat top member of a conventional stepladder. There is a front-to-rear strap 12 which enables quick and easy attachment and release of the accessory holder 2 to the top member of a stepladder. The strap 12 has a first (front) section 14 connected to the inner surface of the front skirt 8. The first section 14 and second (rear) section 16 of the strap 12 contain hook-and-eye attachment surfaces 18 which are capable of forming a secure attachment with each other.

A central area 20 between the two sets of raised retainers 4 contains at least one handle 22 so that the accessory holder 2 may be easily put on and removed from the top member of the stepladder. The handle 22 may be an integral part of the accessory holder 2, as molded, or may be a separate piece attached to the top surface of the central area 20. The wording, "attached to" in this specification is intended to cover both possibilities.

The raised retainers 4 hold storage trays 24 which are useful for holding small tools or hardware. The raised retainers 4 are placed above a closed top 26 and three closed tapered sides 28. The storage trays 24 are held in place by the tapered sides 28.

There is a frame 32 around portions of the perimeter of the accessory holder 2. The frame 32 is slightly removed from the edges of the accessory holder 2 and serves as a convenient location to hold clips attached to tools and other small articles needed by the worker.

The accessory holder 2 of this embodiment of the invention has hangers 34 located at convenient locations around the perimeter of the accessory holder 2. The hangers 34 may take the form of hooks 36 or circular holders (rings) 38. In one preferred embodiment, a hook 36 and a ring 38 are located on one side of the accessory holder 2 in such a way that the hook 36 may hold the handle of an electric tool, such as a drill, and the ring 38 may hold the forward end of the tool. The top of a hanger shaft 40 contains a transverse cylindrical bar 42 giving the hanger 34 a T-shaped appearance.

Figure 5:
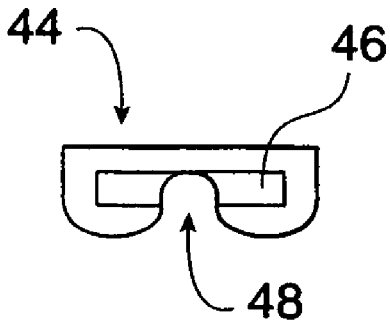
FIG. 5 is a plan view of a holder for a hanger.

Holders 44 for the hangers 34 are located at convenient locations about the perimeter of the accessory holder 2. Preferably, there are two hangers 34 on each side, one hanger 34 on the front, and one hanger 34 on the rear surface of the accessory holder 2. To accommodate the hangers 34, gaps are made in the peripheral frame 32. As seen in FIG. 5, the holder 44 contains a transverse groove 46 which is parallel to the surface of the accessory holder 2. The transverse groove 46 can hold the transverse bar 42 of the hanger 34. There is a centrally located notch 48 in the holder 44 which can accommodate the shaft 40 of the hanger 34. Thus, hooks 36 and rings 38 may be located quickly and easily in convenient locations along the periphery of the accessory holder 2 by placing the bar 42 in the groove 46 and allowing the shaft 40 to pivot downwardly to snap into the centrally located notch 48. The hangers 34 can be easily removed by simply pulling the shafts 40 outwardly out of the notches 48 and lifting and moving the hangers 34 upwardly.

Figure 6:
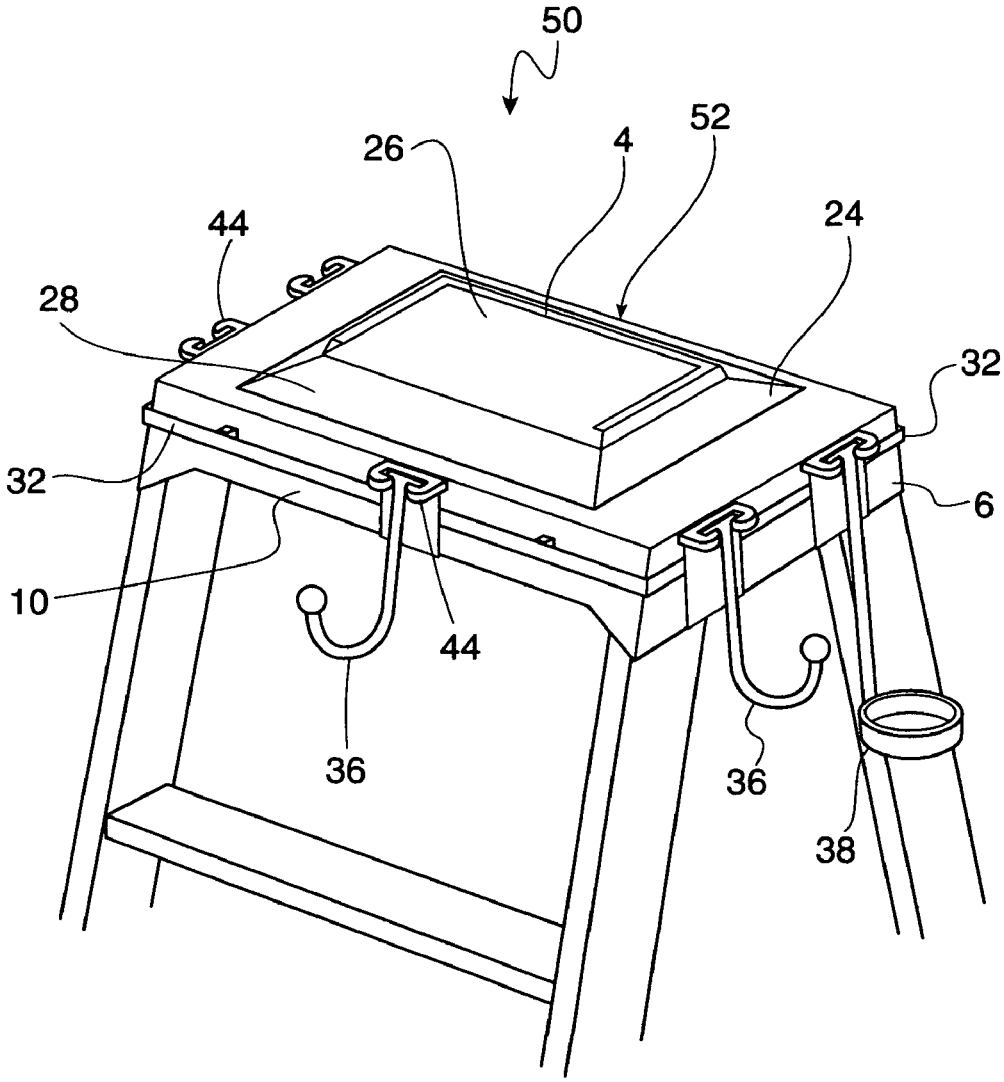
FIG. 6 is an elevational perspective view of the top portion of a stepladder of the second embodiment of this invention.

A second embodiment will now be discussed with reference to FIG. 6 with further reference to FIGS. 1-5.

A stepladder 50 has permanently attached thereto as part thereof a top member 52 having raised retainers 4, a front skirt 8, a rear skirt 10, two side skirts 6, and a frame 32.

The top member 52 is useful for holding bins or small tools. The top member 52 contains a series of hanger holders 44 at convenient locations around the periphery thereof. Preferably, there are two holders 44 on each side, one holder 44 on the front, and one holder 44 on the rear surface of the top member 52. To accommodate the holders 44, there are gaps in the peripheral frame 32. As seen in FIG. 5, the hanger holder 44 contains a transverse groove 46 which is parallel to the surface of the top member 52. The transverse groove 46 can hold the transverse bar 42 of the hanger 34. There is a centrally located notch 48 in the holder 44 which can accommodate the shaft 40 of the hanger 34. Thus, hooks 36 and rings 38 as described with reference to the first embodiment may be located quickly and easily in convenient locations along the periphery of the top member 52 by placing the bar 42 in the groove 46 and allowing the shaft 40 to pivot downwardly to snap into the centrally located notch 48. The hangers 34 can be easily removed by simply pulling the shafts 40 outwardly out of the notches 48 and lifting and moving the hangers 34 upwardly.

There is a frame 32 around portions of the perimeter of the top member 52 and slightly removed from the edges of the top member 52. The purpose of this frame 32 is to serve as a point of attachment for clips which hold small articles needed by the worker.

The raised retainers 4 hold a storage tray 24 which is useful for holding small tools or hardware. The raised retainers 4 are placed on top of a closed top 26 and three closed tapered sides 28. The storage tray 24 is held in place by the inwardly sloping sides 28.

A third embodiment will now be described with reference to FIGS. 7-11.

The frame 54 of the accessory holder 56 is made of a single piece of metal or plastic which may be injection molded as a single piece for ease of manufacture. The size of the frame 54 is such as to fit over the top member of conventional step ladders. The frame 54 is rectangular in shape and has a first (front) section 58, a second (rear) section 60, and two side sections 62.

Figure 7:
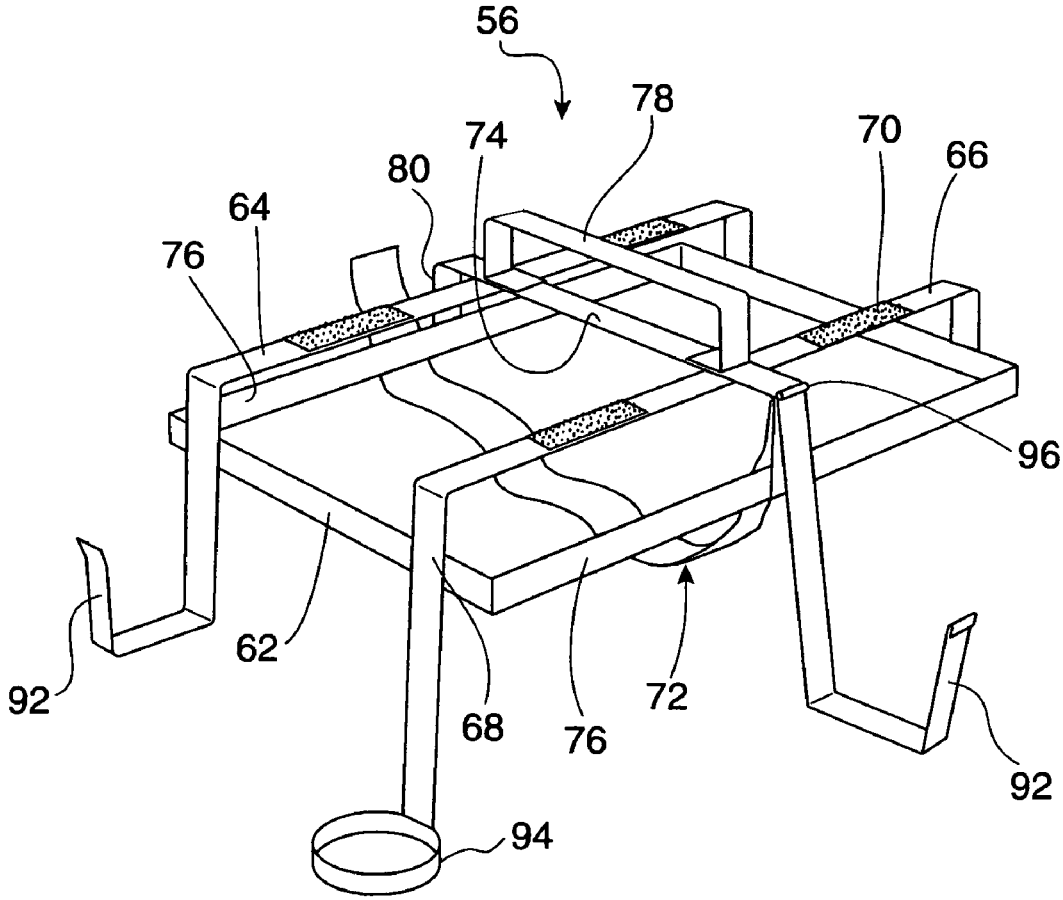
FIG. 7 is an elevational perspective view of the accessory holder of the third embodiment of the invention.
Figure 8:
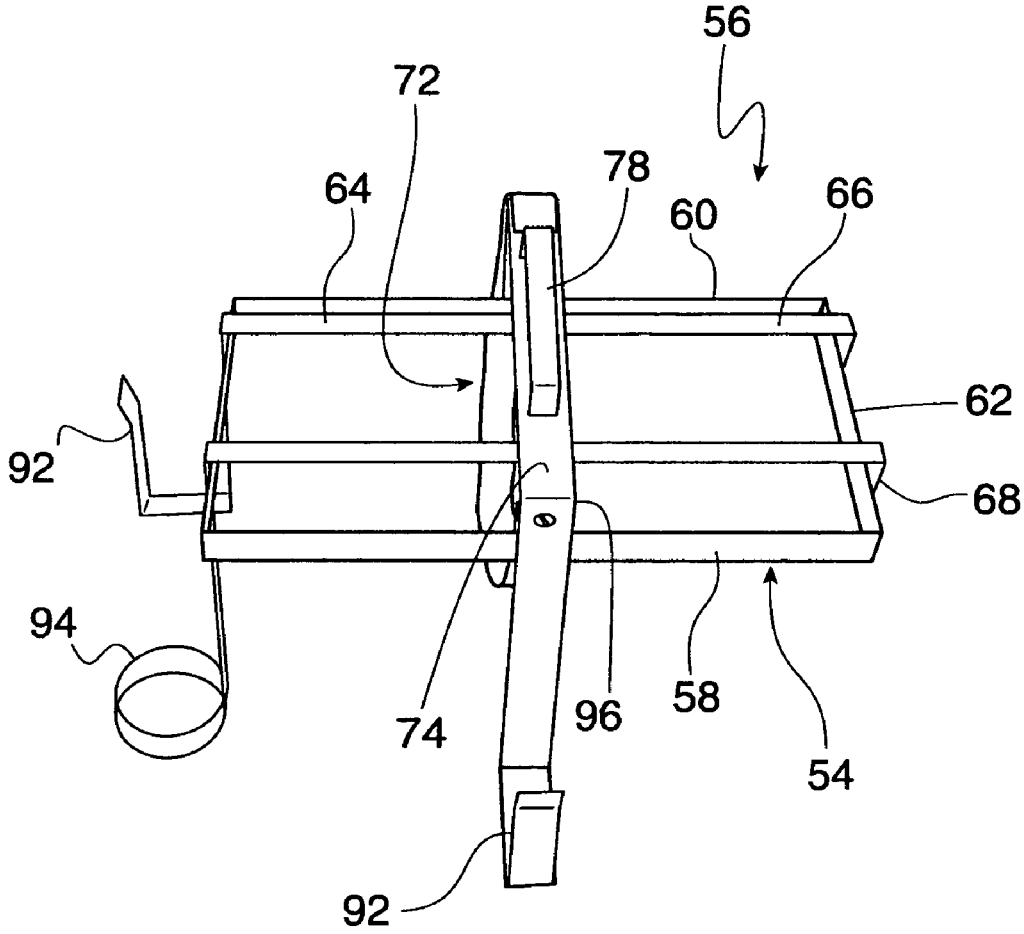
FIG. 8 is another elevational perspective view of the accessory holder of the third embodiment of the invention.

The frame 54 further contains a top surface 64. The top surface 64 may be provided by a plurality of lateral strips 66 which are raised above the side sections 62 by lateral risers 68 as shown in FIGS. 7 and 8. The top surfaces 64 may be supplied with non-skid material 70 to prevent the movement of bins or buckets placed thereon.

Figure 9:
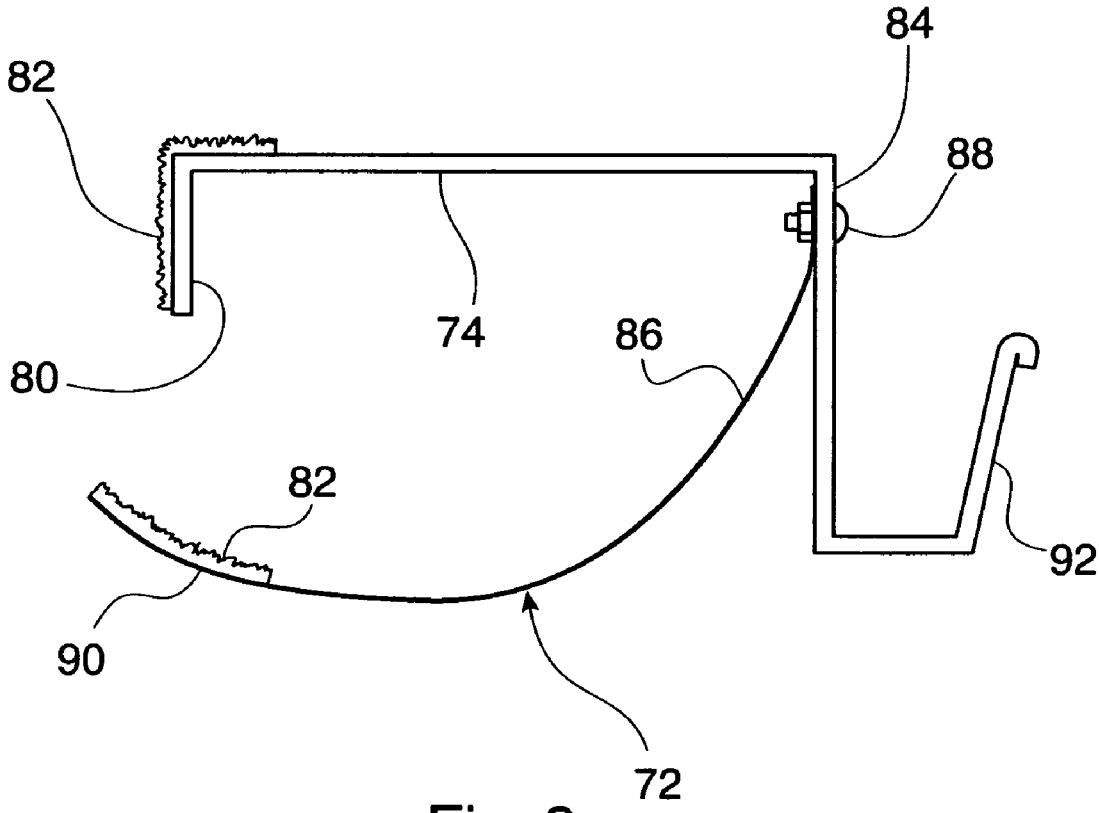
FIG. 9 is an elevational side view of the accessory holder of the third embodiment showing the details of the attachment strap.
Figure 10:
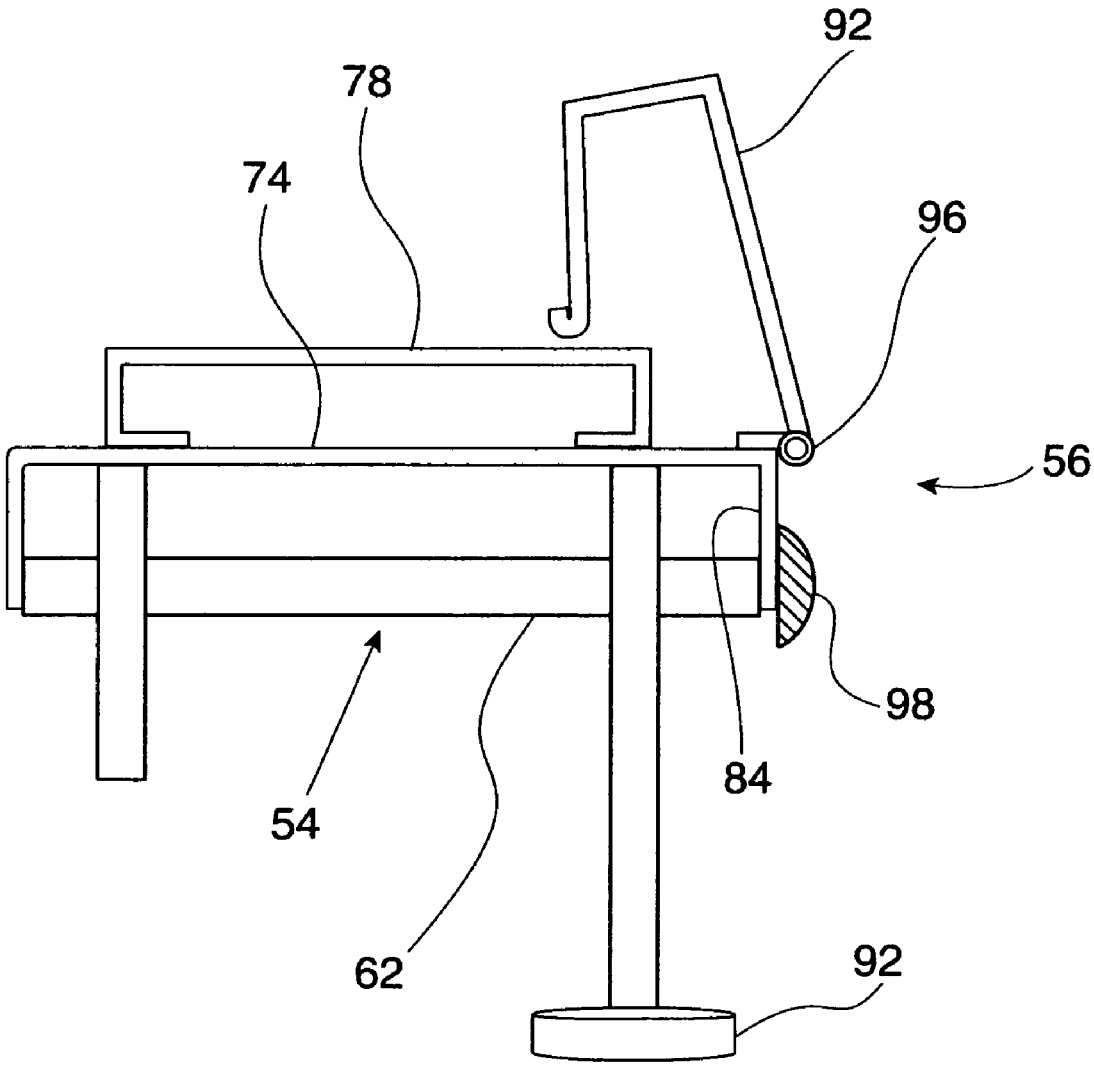
FIG. 10 is an elevational side view of the accessory holder of the third embodiment of this invention showing the ability of the front hook to be hinged so as to allow the ladder to be placed against a wall.
Figure 11:
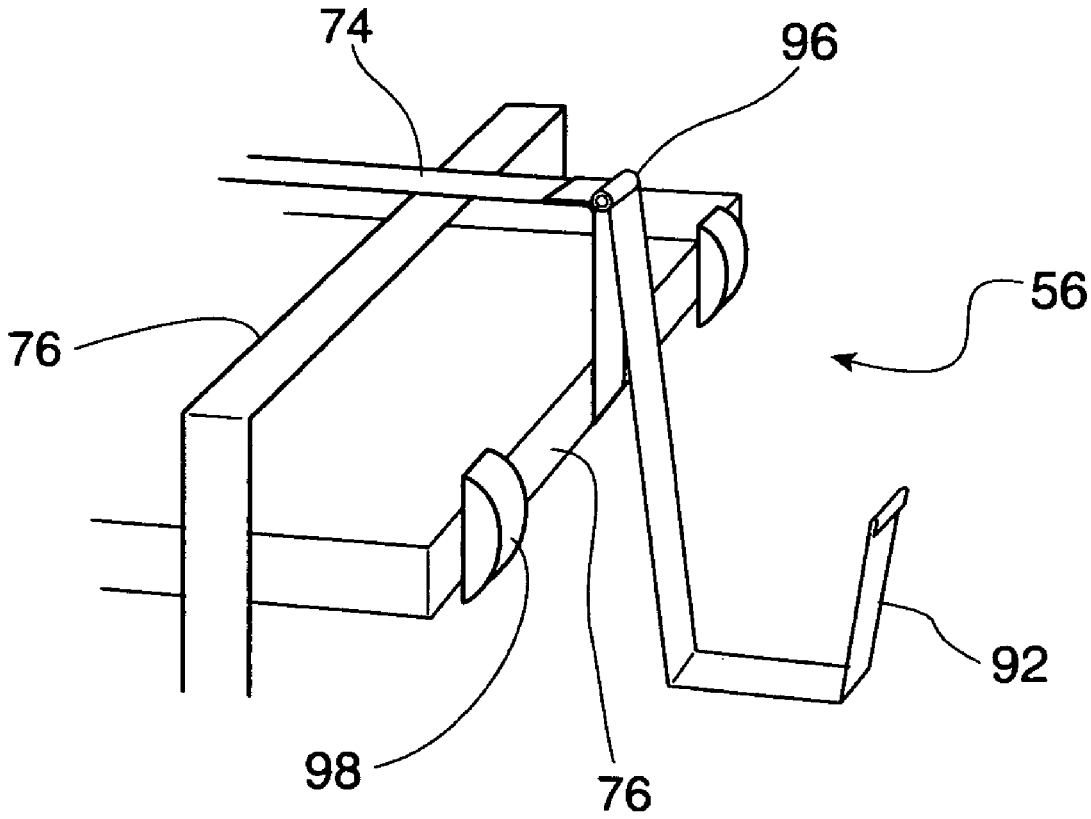
FIG. 11 is an elevational perspective view of the front of the frame of the third embodiment of the invention showing the front hook and bumpers.

The frame 54 may be attached to the top member of a stepladder by a strap 72 which is best shown in FIGS. 7-9. A central longitudinal piece 74 is attached to a plurality of lateral strips 76. The central longitudinal piece 74 is attached to a longitudinal handle 78. The longitudinal handle 78 enables the user to attach the accessory holder 56 to, and remove it from, stepladders and to easily transport the accessory holder 56 and associated accessories to and from the work site. The central longitudinal piece 74 is also attached to a rear riser 80. The rear riser 80 is covered with a hook-and-eye attachment surface 82. The central longitudinal piece 74 is further attached to a front riser 84. The strap 72 has a first (front) section 86 connected to the front riser 84 by means of a connector 88. The second (rear) section 90 of the strap contains a hook-and-eye attachment surface 82 which is capable of forming a secure attachment with the corresponding attachment surface 82 of the rear riser 80.

Each of the lateral strips 76 has lateral ends which are attached to the upper ends of lateral risers 68. The lower ends of the lateral risers 68 are attached to the frame 54.

At least one hook 92 or circular holder 94 may be attached to the frame 54. For ease of manufacture and added strength, it is preferred to have the hooks 92 and circular holders 94 as extensions of the lateral risers 68. The hook 92 and circular holders 94 combine to form a holder for an electrical tool such as a drill wherein the hook 92 may be used to hold the handle and the circular holder 94 may be used to hold the drill head.

With this arrangement, the central longitudinal piece 74 may be positioned above the top member of a stepladder and the strap 72 may be positioned below the top member of the stepladder and the accessory holder 60 is securely held in place. A hook 92 may be attached to a swivel or hinge 96 on the front of the frame 54 and may be positioned in a down position in which it is available to act as a holder for buckets or tools or may be positioned in an up position in which it is out of the way and the stepladder may be leaned against a wall.

When it is intended that the stepladder be leaned against a wall, clip-on bumpers 98 may be easily applied to the front surface of the front section 58 of the frame 54.

Although the invention has been described and illustrated in detail, it is to be clearly understood that the same is by way of illustration and example, and is not to be taken by way of limitation. The spirit and scope of the present invention are to be limited only by the terms of the appended claims.

The invention claimed is:

1. An accessory holder for fitting over a top member of a stepladder, comprising a closed top having a perimeter for fitting on top of the top member, two laterally separated raised retainers, each retainer capable of holding a storage tray therein, which storage tray is capable of sliding laterally into and out of the raised retainer, each of which raised retainers has three closed sides walls connected to the closed top inwardly of the perimeter and extending upwardly from the closed top, and one open side, the open side of each retainer faces opposite sides of the perimeter and away from each other; a flat central area between the two raised retainers; front, rear, and side skirts connected to the perimeter and extending downwardly from the closed top; a strap for holding the accessory holder to the top member of the stepladder; and a plurality of holders fastened to the skirts, which holders are capable of holding moveable and removable hangers.

2. The accessory holder of claim 1, wherein at least one handle is attached to the flat central area between the two raised retainers of the accessory holder.

3. The accessory holder of claim 2, wherein there is a frame partially around, and slightly separated from, the perimeter of the accessory holder.

4. The accessory holder of claim 3, wherein the accessory holder contains storage trays held in place within the raised retainers.

5. The accessory holder of claim 4, wherein the holders for hangers have hangers attached thereto.

6. The accessory holder of claim 5, wherein the hanger holders have transverse slots therein and the hangers have proximal ends which contain transverse bars which fit into the transverse slots.

* * * * *